United States Patent [19]

Lau

[11] 4,435,264

[45] Mar. 6, 1984

[54] MAGNESIUM ANODE BACKFILLS

[75] Inventor: Philip Y. Lau, Houston, Tex.

[73] Assignee: The Dow Chemical Company, Midland, Mich.

[21] Appl. No.: 353,461

[22] Filed: Mar. 1, 1982

[51] Int. Cl.[3] ..... C23F 13/00; C04B 33/13

[52] U.S. Cl. ..... 204/197; 501/141; 501/146; 501/148; 106/DIG. 4; 106/900; 204/148

[58] Field of Search ..... 501/141, 146, 148; 106/DIG. 4; 204/197, 148

[56] References Cited

U.S. PATENT DOCUMENTS

| | | | |
|---|---|---|---|
| 2,106,410 | 1/1938 | Malinovszky | 106/DIG. 4 |
| 2,478,479 | 9/1949 | Grebe et al. | 204/197 |
| 2,480,087 | 9/1949 | Robinson et al. | 204/197 |
| 2,525,665 | 10/1950 | Glesner et al. | 204/197 |
| 2,527,361 | 10/1950 | Hunter | 204/197 |
| 2,567,855 | 9/1951 | Pippin et al. | 204/197 |
| 2,601,214 | 6/1952 | Robinson et al. | 204/197 |
| 2,810,690 | 10/1957 | Campise et al. | 204/197 |

*Primary Examiner*—Mark Bell
*Attorney, Agent, or Firm*—W. J. Lee

[57] ABSTRACT

Backfills for magnesium galvanic anodes are prepared by blending calcium sulfite, $B(OH)_3$, and bentonite, wherein the bentonite contains a substantial amount of alkaline earth metal bentonite, such as calcium-bentonite.

16 Claims, No Drawings

MAGNESIUM ANODE BACKFILLS

BACKGROUND OF THE INVENTION

In the cathodic protection of ferrous structures, especially pipelines, the use of a mixture of alkali bentonite, gypsum and sodium sulfate as a backfill for underground magnesium-base anodes is well known, the particulars of which are shown in the patents listed below. It is noted that among the teachings in the patents it is taught that "alkali bentonite" is the operable form of bentonite, but that "alkaline earth bentonite" is inoperable.

U.S. Pat. No. 2,478,479 discloses a magnesium-base alloy on a Mg-Al alloy core, buried in a backfill of bentonite-gypsum mixture, for galvanic protection of a ferrous metal pipeline.

U.S. Pat. No. 2,480,087 discloses a backfill consisting of naturally-occurring "bentonite" in admixture with gypsum and a water-soluble metal salt, such as sodium sulfate. The operable bentonite is said to be "alkali bentonite" in contradistinction to "alkaline earth bentonite" which is said to be inoperable.

U.S. Pat. No. 2,525,665 discloses a gypsum-bentonite-sodium sulfate backfill such as is described in U.S. Pat. No. 2,480,087 above.

U.S. Pat. No. 2,527,361 discloses a gypsum-bentonite-sodium sulfate backfill such as is described in U.S. Pat. No. 2,480,087 above.

U.S. Pat. No. 2,567,855 discloses a backfill of gypsum-bentonite-sodium sulfate.

U.S. Pat. No. 2,601,214 discloses a backfill comprising a major proportion of magnesium sulfite and a minor proportion of "sodium-type" bentonite (montmorillonite).

A reference for mineralogical information about bentonite clays, and other clays of the montmorillonite type, is "Applied Clay Mineralogy" by Ralph E. Grim, published by McGraw-Hill Book Company, Inc., New York, 1962.

As used in this application the term "bentonite" is used in referring to minerals which are largely composed of montmorrillonite clays such as are mined as alterations of volcanic ash, and the like. Alkali metal bentonites (e.g., sodium bentonite) are known to swell upon addition of water, and to contract or de-swell upon removal of water, in contradistinction to alkaline earth metal bentonites (e.g., calcium bentonite) which undergo little, if any, such swelling or de-swelling.

SUMMARY OF THE INVENTION

Bentonite clays containing a substantial amount, preferably a major amount, of alkaline earth metal bentonite, e.g., calcium-bentonite, admixed with calcium sulfite, is used as a back-fill material for underground installations of galvanic magnesium anodes for the cathodic protection of ferrous metal structures, e.g., pipelines. Preferably, the backfill material also contains boric acid, $B(OH)_3$.

DETAILED DESCRIPTIONS

As stated above, the bentonites of the present invention are those which contain a substantial amount of the alkaline earth metal variety, especially the calcium-bentonite variety. A "substantial amount" is that amount which substantially, and beneficially, reduces the swelling and de-swelling properties of the bentonite as the water content is increased or decreased, respectively.

Preferably, the bentonite contains a major amount (about 50% or more) of the calcium-bentonite variety. The variety of alkaline earth metal bentonites, mined and identified as calcium-bentonite, is largely of that variety, though it may contain minor amounts of other forms of bentonite-type clays. It is within the purview of the present invention to blend "calcium-bentonite" with the commonly used "sodium-bentonite" to provide in the blend a substantial amount, preferably about 50% or more, of the calcium bentonite. The calcium-bentonite may be, but does not need to be, mixed with, or diluted with, the sodium-bentonite variety.

Along with the Ca-bentonite there is used an appreciable amount of calcium sulfite ($CaSO_3$) instead of the gypsum (calcium sulfate) which is commonly used with the Na-bentonite clays as a backfill for Mg anodes. $MgSO_3$ may be used in place of part or all of the $CaSO_3$, but is not preferred.

A beneficial ingredient, for use with the Ca-bentonite/$CaSO_3$ mixtures, is $B(OH)_3$. This $B(OH)_3$ additive is especially beneficial where the mixture needs to enhance anode current capacity.

The magnesium anodes, with which the present novel backfills are used, may be any of those compositions or alloys wherein the principal sacrificial metal is magnesium. Among the Mg anodes which have been commercially popular are those wherein the Mg contains small percents of Mn, Al, and/or Zn alloyed therewith, along with impurities normally found in Mg. The present novel backfills are useable with any of the magnesium anodes.

In contradistinction to sacrificial aluminum anodes, where halide ions in the backfill are often desired to disrupt the passivating effect of $Al(OH)_3$ formed on the Al anode, Mg anodes tend to suffer accelerated and wasted corrosion if halide ions are added to the backfill.

In the customary manner of providing backfills for underground installations of Mg anodes, the present backfills may be packed around anodes placed in holes in the ground or may be packaged around the anodes before being installed in the holes. The backfill may be wetted with water either before or after being installed in the ground. Preferably, the present backfills are utilized in packaged arrangements, wherein the anode is encompassed in the backfill, whereby the entire package is installed in the ground, wired electrically from the core of the anode to the metal structure to be protected, and water is added to wet (usually saturate) the backfill. The packaged material is contained in a water-permeable material, generally cloth and/or paper. It is not generally necessary that the water-permeable material retain any substantial strength after prolonged or repeated wettings.

When packaged materials are placed into a hole, the void spaces remaining in the hole are to be filled in with earth or additional backfill material. It is generally best if the earth or additional backfill is slurried in water and poured in so as to be certain that no void spaces remain around the package. In very damp or wet soil, the packaged material will become wetted naturally, but in dry or well-drained soils, it is preferred to add water to achieve a good initial voltage in the installation.

In contradistinction to other sacrificial anodes using conventional backfills, or no backfills, where one is likely to encounter accelerated and wasted corrosion and a subsequent loss of current capacity, Mg anodes imbedded in the present backfill material usually exhibit not only increased current capacity, but may also exhibit increased operating potentials.

The amount of Ca-bentonite variety in the bentonite mineral for use in the present invention, in order to have an appreciable effect on the swelling/de-swelling of the backfill mixture, should comprise preferably about 50% or more of the bentonite component; virtually all of the bentonite component may be of the Ca-bentonite variety.

The ratio of $CaSO_3$/bentonite is preferably in the range of about 0.2 to about 5.0. At percentages outside this range, the mixture performs substantially as bentonite on the one hand, or as $CaSO_3$ on the other. Most preferably, the range of ratios for $CaSO_3$/bentonite is about 0.5 to about 4.0.

The amount of $B(OH)_3$ which is added may comprise, on a weight basis, up to about 16% of the total, preferably about 0.2 to about 6%, most preferably about 0.5 to about 5%.

It will be recognized by skilled Mg anode artisans that the half-cell potential for a Mg alloy is usually well below the theoretical potential calculated from the electromotive series for that alloy. Even in a large masterbatch of molten Mg alloy, the many anodes which are cast therefrom may exhibit a range of half-cell potentials measured in a constant screen test environment. Differences in amount of impurities, oxidation, heat-history, and other variables can cause a significant spread of tested potentials in the cast anodes. Then when the anodes are installed in various backfills, it may be found that some of them exhibit lower performance than that achieved in the standard screening test while some may perform better.

With the present novel backfills, as with previously used backfills, the installations along a pipeline (or other ferrous structure) should take into account the soil composition, its moisture content, and its resistivity, including its drainage characteristics. With knowledge of the soil conditions and with knowledge of the expected operating potential and current capacity of the anode (in a given backfill) intelligent placement of the anodes can be made, each anode protecting a calculated area of the ferrous structure.

EXPERIMENTAL

In the Examples given below, the Mg anodes tested were machined rods 6" in length and ⅝" in diameter. The Mg anode contained about 1.03–1.31% Mn, about 0.0023–0.0034% Al, about 0.0015–0.0020% Cu, about 0.018–00.034% Fe, about 0.0003–0.0005% Ni, with trace amounts of other impurities. The tests were made in testing cans made of carbon steel, 7" tall by 4" I.D.; the inside bottom of the can was covered with a thin layer of epoxy resin to minimize end effects. The candidate backfill was poured into the can, the preweighed anode pencils were centrally positioned in the backfill, through holes in a rubber stopper, there being about 3.5–4.0 inches of the anode immersed in the backfill. The test cans were connected in series to a rectifier having a copper coulometer in the circuit. The current density used was 36 mA/ft.$^2$ and periodic potential readings were taken using a saturated colomel reference electrode (SCE). The test duration was from 2 weeks to 6 weeks. A cleaning solution consisting of 25% chromic acid solution (50° C.) was used to clean the anodes for re-weighing to calculate weight loss. Current capacity of the Mg anode was determined from the knowledge of the weight gain of the coulometer cathode and the pencil weight loss.

For comparison or control purposes, various Mg anode specimens were tested in saturated $CaSO_4$ solution; they were found to exhibit a mean initial potential of 1.5585±0.0065 volt(−), a mean final potential of 1.539±0.018 volt(−), and a mean current capacity of 440±33 amp. hrs. per lb. The following examples employed Ca-bentonite along with $CaSO_3$ at various ratios, along with $B(OH)_3$ added to provide an amount ranging from 0% to 40% of the total weight (based on solids). The more soluble ingredient was dissolved in 500 ml. water to the extent of its solubility. About 500 gm. of the specified ingredients were used and well mixed before placing in the test can.

EXAMPLE I

A $CaSO_3$/Ca-bentonite mixture, at a $CaSO_3$/Ca-bentonite ratio of 0.5, without $B(OH)_3$ added, exhibited an initial closed circuit potential of 1.628 volts(−), a final potential of 1.596 volts(−), and a current capacity of 562 amp. hrs. per lb. A series of tests using $B(OH)_3$ content of from 0.8% to 5% exhibited a mean initial voltage of 1.63±0.10 volts(−), a mean final voltage of 1.62±0.078, and a mean current capacity of 568±73 amp. hrs. per lb. The best results for addition of $B(OH)_3$ were in the 1.5%–5% $B(OH)_3$ range.

A control test, using only Ca-bentonite exhibited a current capacity of 433 amp. hrs. per lb. and a control test using only $CaSO_3$ exhibited a current capacity of 402 amp. hrs. per lb.

EXAMPLE II

In similar manner to Example I above, the following data are obtained using $CaSO_3$/Ca-bentonite ratio of 1.0:

| Backfill | Potential, -V initial | Potential, -V final | Current Capacity A-Hr/lb. |
|---|---|---|---|
| no $B(OH)_3$ added | 1.602 | 1.585 | 485 |
| 0.5–5% $B(OH)_3$ added (mean values) | 1.60 ± 0.12 | 1.59 ± 0.098 | 561 ± 45 |

The best improvement in current capacity is exhibited in the 1.0%–5% $B(OH)_3$ range.

EXAMPLE III

In similar manner to Example I above, various amounts of $B(OH)_3$ are added to $CaSO_3$/Ca-bentonite; ratio 2.0, as follows:

| Backfill | Potential, -V initial | Potential, -V final | Current Capacity A-Hr/lb. |
|---|---|---|---|
| no $B(OH)_3$ added | 1.562 | 1.572 | 447 |
| 0.5–5% $B(OH)_3$ added (mean values) | 1.59 ± 0.122 | 1.60 ± 0.126 | 545 ± 71 |

Improvement in current capacity is exhibited over the range of 0.5–5.0% $B(OH)_3$, with the best improvement being exhibited in the range of 1.5–5.0% $B(OH)_3$.

EXAMPLE IV

In similar manner to Example I above, various amounts of $B(OH)_3$ are added to $CaSO_3$/Ca-bentonite, ratio 3.0, as follows:

| Backfill | Potential, -V initial | Potential, -V final | Current Capacity A-Hr/lb. |
|---|---|---|---|
| no $B(OH)_3$ added | 1.559 | 1.561 | 421 |
| 0.5–5% $B(OH)_3$ added (mean values) | 1.61 ± 0.125 | 1.60 ± 0.117 | 540 ± 78 |

Improvement in current capacity is exhibited over the range of 0.5–5.0% $B(OH)_3$, with the best improvement being exhibited in the range of 1.5–5.0% $B(OH)_3$.

EXAMPLE V

In similar manner to Example I above, various amounts of $B(OH)_3$ are added to $CaSO_3$/Ca-bentonite, ratio 4.0, as follows:

| Backfill | Potential, -V initial | Potential, -V final | Current Capacity A-Hr/lb. |
|---|---|---|---|
| no $B(OH)_3$ added | 1.558 | 1.578 | 535 |
| 0.5–5.0% $B(OH)_3$ added (mean values) | 1.57 ± 0.147 | 1.56 ± 0.137 | 555 ± 78 |

The best improvement in current capacity is exhibited in the range of 1.5–5.0% $B(OH)_3$.

EXAMPLE VI

In similar manner to Example I above, various amounts of $B(OH)_3$ are added to $CaSO_3$/Ca-bentonite, ratio 2.5, as follows:

| Backfill | Potential, -V initial | Potential, -V final | Current Capacity A-Hr/lb. |
|---|---|---|---|
| no $B(OH)_3$ added | 1.563 | 1.580 | 474 |
| 1.41% $B(OH)_3$ added | 1.581 | 1.638 | 623 |
| 3.73% $B(OH)_3$ added | 1.511 | 1.505 | 606 |
| 8.56% $B(OH)_3$ added | 1.596 | 1.564 | 317 |
| 12.31% $B(OH)_3$ added | 1.619 | 1.483 | 254 |
| 15.88% $B(OH)_3$ added | 1.619 | 1.515 | 168 |

A graph of the above data for current capacity suggests, that at this 2.5 ratio of $CaSO_3$/Ca-bentonite, the amount of addition of $B(OH)_3$ is preferably about 6% or less.

The above experimental data and examples illustrate various embodiments within the purview of the present invention, but the invention is not limited to the particular embodiments illustrated. It is within the purview of the present invention to provide in the backfill formulations other ingredients which will modify the moisture-retention properties, the pH, the conductivity, or other properties.

I claim:

1. A backfill composition for use with underground placement of magnesium galvanic anodes, said composition consisting essentially of a mixture of calcium sulfite, $B(OH)_3$, and bentonite, wherein said bentonite contains a substantial amount of alkaline earth metal bentonite, wherein the $B(OH)_3$ is present in a positive amount up to about 16% by weight of the solids in the backfill composition, and wherein the ratio of calcium sulfite/bentonite is in the range of about 0.2 to about 5.

2. The composition of claim 1 wherein the alkaline earth metal bentonite comprises calcium-bentonite.

3. The composition of claim 1 wherein the alkaline earth metal bentonite comprises about 50% or more of the total bentonite.

4. The composition of claim 1 wherein the alkaline earth metal bentonite comprises calcium-bentonite and where the said calcium-bentonite comprises about 50% or more of the total bentonite.

5. The composition of claim 1 wherein the amount of $B(OH)_3$ is in the range of about 0.2% to about 6% by weight of the solids.

6. The composition of claim 1 wherein the amount of $B(OH)_3$ is in the range of about 0.5 to about 5% by weight of the solids.

7. The composition of claim 1 wherein the ratio of calcium sulfite/bentonite is in the range of about 0.5 to about 4.

8. A packaged galvanic anode for underground placement for the cathodic protection of ferrous metal structures, said package comprising a magnesium anode surrounded by a backfill composition which is contained in a water-permeable material, with means for providing electrical wiring between anode and ferrous metal structure, wherein said backfill composition consisting essentially of a mixture of calcium sulfite, $B(OH)_3$, and bentonite, wherein said bentonite contains a substantial amount of alkaline earth metal bentonite, wherein the $B(OH)_3$ is present in a positive amount up to about 16% by weight of the solids in the backfill composition, and wherein the ratio of calcium sulfite/bentonite is in the range of about 0.2 to about 5.

9. The package of claim 8 wherein alkaline earth metal bentonite comprises calcium-bentonite.

10. The package of claim 8 wherein the alkaline earth metal bentonite comprises about 50% or more of the total bentonite.

11. The package of claim 8 wherein the alkaline earth metal bentonite comprises calcium-bentonite and where the said calcium-bentonite comprises about 50% or more of the total bentonite.

12. The package of claim 8 wherein the ratio of calcium sulfite/bentonite is in the range of about 0.5 to about 4.

13. The package of claim 8 wherein the $B(OH)_3$ comprises about 0.2% to about 6% by wt. of the solids in the backfill material.

14. The package of claim 8 wherein the ratio of calcium sulfite/bentonite is in the range of about 0.5 to about 4.

15. The package of claim 8 wherein the amount of $B(OH)_3$ is in the range of about 0.5 to about 5% by weight of the solids in the backfill material.

16. The package of claim 8 wherein the amount of $B(OH)_3$ is in the range of about 0.2% to about 6% by weight of the solids and the ratio of calcium sulfite/bentonite is in the range of about 0.2 to about 5.

* * * * *